United States Patent [19]

Miyazaki

[11] Patent Number: 4,825,121

[45] Date of Patent: Apr. 25, 1989

[54] IN-LINE TYPE ELECTRON GUN FOR COLOR PICTURE TUBE

[75] Inventor: Masahiro Miyazaki, Mobara, Japan

[73] Assignee: Hitachi, Ltd., Tokyo, Japan

[21] Appl. No.: 146,393

[22] Filed: Jan. 21, 1988

[30] Foreign Application Priority Data

Jan. 26, 1987 [JP] Japan ..... 62-14017

[51] Int. Cl.[4] ..... H01J 29/58

[52] U.S. Cl. ..... 313/414; 313/447

[58] Field of Search ..... 313/446, 447, 448, 458, 313/460, 409, 414

[56] References Cited

U.S. PATENT DOCUMENTS 4,063,128 12/1977 Hughes ..... 313/447 X 4,366,414 12/1982 Hatayama et al. ..... 313/458 X

FOREIGN PATENT DOCUMENTS 15242 5/1985 Japan .

*Primary Examiner*—Kenneth Wieder

*Attorney, Agent, or Firm*—Antonelli, Terry & Wands

[57] ABSTRACT

In an electron gun for a color picture tube having three cathodes which are arrayed orthogonally to the axial direction of the tube and at equal intervals on a straight line, and a first grid and a second grid which are successively arrayed and each of which has apertures aligned with electron beam paths corresponding to the three cathodes; the improvement comprising the fact that the surface of at least one of the first grid and the second grid opposing to the other includes aperture-vicinity flats which correspond to the respective apertures, and annular margins which are protruded toward the other opposing grid around the aperture-vicinity flats, and that the annular margin corresponding to the central aperture is retracted from a plane which forms the two annular margins corresponding to the outer apertures, while the aperture-vicinity flats corresponding to the three apertures are so formed as to be substantially coplanar.

4 Claims, 3 Drawing Sheets

IN-LINE TYPE ELECTRON GUN FOR COLOR PICTURE TUBE

BACKGROUND OF THE INVENTION

The present invention relates to an in-line type electron gun for a color picture tube, and more particularly to the structure of a first grid and a second grid which constitute the electron gun.

A prior-art electron gun for a color picture tube has a structure as shown in FIGS. 1 and 2 by way of example. As illustrated in FIG. 1, the electron gun includes three cathodes 1A, 1B and 1C which are arrayed orthogonally to the axis of the tube and at equal intervals on a straight line, and a first grid 2, a second grid 3, a focusing electrode 4 and an anode 5 which are disposed at predetermined intervals in this order from the side of the cathodes 1A–1C toward a screen not shown and each of which has apertures aligned with beam paths corresponding to three electron beams emitted from the cathodes 1A–1C.

The cathodes 1A, 1B and 1C, the first grid 2 and the second grid 3 construct a so-called "triode portion." Usually, variable voltages of 0–200 V are applied to the cathodes 1A–1C, a voltage of 0 V is applied to the first grid 2, and a voltage of about 600 V is applied to the second grid 3, whereby the electron beams 6A, 6B and 6C are formed. Further, the focusing electrode 4 is supplied with a voltage with which the electron beams 6A–6C are focused to the optimum on the screen though not depicted in the figure, and the anode 5 is supplied with a high voltage equal to that of the screen.

In order to maintain the orthogonalities of the electrodes to the beam paths, the parallelism among the electrodes, and the coaxialities between the respectively corresponding apertures of the electrodes, the electron gun for the color picture tube constructed as stated above is assembled in such a way that three mandrels arranged on straight lines and held parallel to one another are respectively passed through the three apertures of the electrodes, and that spacers each having surfaces parallel to each other are inserted in the interspaces between the respectively adjacent electrodes.

In case of such assemblage, the first grid 2 and the second grid 3 have heretofore been set up in order to secure the mutual parallelism thereof as disclosed in, for example, the official gazette of Japanese Utility Model Publication No. 15242/1985. More specifically, as illustrated in FIG. 2, regarding the first grid 2, the peripheral parts **7*a* and 7*c* of respective outer apertures 2*a* and 2*c* opposing to the second grid 3 are protruded to the side of the second grid 3 more than the peripheral part 7*b* of a central aperture 2*b*, while regarding the second grid 3, the peripheral parts 8*a* and 8*c* of respective outer aperatures 3*a* and 3*c* opposing to the first grid 2 are protruded to the side of the first grid 2 more than the peripheral part 8*b* of a central aperture 3*b*. Thus, only the outer peripheral parts 7*a* and 8*a*, and 7*c* and 8*c* of the electrodes 2 and 3 come into contact with the spacers (not shown) which are used for setting the mutual interval between the first grid 2 and the second grid 3. Therefore, the mutual parallelism between the first grid 2 and the second grid 3** can be enhanced.

With the prior art, the intervals la and lc between the outer apertures of the first grid 2 and the second grid 3 become, in effect, smaller than the interval lb between the central apertures thereof.

In general, in a color picture tube, cathode cutoff voltages (namely, cathode voltages with which cathode currents become "0") $E_{kco}$ need to be equalized for three electron beams to the end of equalizing the cathode drive characteristics of the electron beams corresponding to red, green and blue. It is known that the relationship of the following equation holds between the cathode cutoff voltage $E_{kco}$ and the dimensions of the triode portion:

$$E_{kco} = A \frac{D^3}{S \cdot T_1 \cdot l} E_{c2} \tag{1}$$

where A denotes a constant, D the diameter of each aperture of the first grid 2, S the spacing between each cathode and the corresponding aperture of the first grid 2, $T_1$ the thickness of the vicinity (for example, **22*a* in FIG. 2) of the aperture of the first grid 2, l the interval between the corresponding apertures of the first grid 2 and the second grid 3, and $E_{c2}$ the voltage of the second grid 3**.

In the case of the prior art, since the intervals la and lc are smaller than the interval lb as shown in FIG. 2, the spacings Sa and Sc need to be made greater than the spacing Sb in accordance with the relationship of Eq. (1).

In the triode portion in which the individual dimensions l and S are unequal, however, differences develop in lens characteristics which are formed in the triode portion, and differences also develop in the divergent angles of the electron beams which are emitted from the triode portion. As a result, the angles of incidence of the electron beams on a main focusing lens become unequal, and the focusing conditions of the electron beams become different. That is, the optimum focusing voltages $V_f$ of the electron beams become unequal. Moreover, this tendency intensifies as beam currents $I_b$ increase.

It has been experimentally and calculatively revealed that, in a case where the interval l is small and where the spacing S is great, the divergent angle enlarges relative to a case where the interval l is great and where the spacing S is small, so the optimum focusing voltage $V_f$ of the electron beam rises.

In the prior art, accordingly, the voltage $V_f$ of each of the outer beams becomes higher than that of the central beam. In actuality, when the beam currents $I_b$ are changed as shown in FIG. 3, the optimum focusing voltage $V_f$ of the central electron beam 6B shown in FIG. 1 becomes a characteristic 20 indicated by a solid line, and that of each outer electron beam 6A or 6C becomes characteristic 21 indicated by a broken line.

In this manner, with the prior-art electron gun, when the beam currents $I_b$ are changed, the central electron beam 6B and the outer electron beam 6A or 6C exhibit the different variations of the optimum focusing voltages $V_f$. The prior art has therefore involved the problem that, when either electron beam is set at the optimum focusing condition, the other electron beam deviates therefrom, so a vivid picture is not produced on the phosphor screen.

SUMMARY OF THE INVENTION

An object of the present invention is to provide an electron gun for a color picture tube in which the focusing voltages of a central electron beam and outer electron beams are equalized to attain a good picture quality.

The above object is accomplished in such a way that the surface of at least one of a first grid and a second grid opposing to the other comprises aperture-vicinity or -defining flats which correspond to respective apertures, and annular margins which are protruded toward the other opposing grid around the aperture-vicinity flats, and that the annular margin corresponding to the central aperture is retracted from a plane which forms the two annular margins corresponding to the outer apertures, while the aperture-vicinity flats corresponding to the three apertures are so formed as to be substantially coplanar.

DESCRIPTION OF THE PREFERRED EMBODIMENTS

Owing to the construction of the present invention as stated in the section of SUMMARY, at least the outer margins of each grid come into contact with spacers (not shown) for setting the mutual interval between the first grid and the second grid. Therefore, the orthogonalities of and the mutual parallelism between the first grid and the second grid can be enhanced.

Furthermore, the interval between the central apertures of the first and second grids can be substantially equalized to each of the intervals between the outer apertures thereof. Accordingly, the cutoff voltages of the central beam and the outer beams need to be set equal, so that the spacings between the cathodes and the apertures of the first grid can be substantially equalized for the central beam and the outer beams. Thus, the lens characteristics of the triode portion for the individual electron beams can be brought into agreement, and the optimum focusing voltages of the respective electron beams can be finally brought into agreement.

Figure 4:
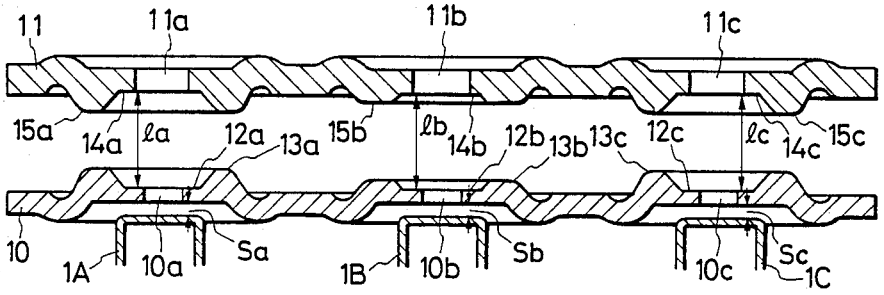
FIG. 4 is a sectional view showing the construction of an embodiment of a triode portion for use in an electron gun for a color picture tube according to the present invention.

Now, an embodiment of the present invention will be described with reference to FIG. 4. The surface of the first grid 10 opposing to the second grid 11 includes in correspondence with respective electron beam apertures 10*a*, 10*b* and 10*c*, flats 12*a*, 12*b* and 12*c* in the vicinities of the apertures or defining the apertures, and annular margins 13*a*, 13*b* and 13*c* protruded to the side of the second grid 11 around the aperture-vicinity flats 12*a*, 12*b* and 12*c*. In addition, the central aperture-vicinity flat 12*b* and the outer aperture-vicinity flats 12*a* and 12*c* are so formed as to be substantially coplanar, while the central annular margin 13*b* is so formed as to be retracted from the plane of the outer annular margins 13*a* and 13*c*.

Likewise, the surface of the second grid 11 opposing to the first grid 10 includes in correspondence with respective electron beam apertures 11*a*, 11*b* and 11*c*, flats 14*a*, 14*b* and 14*c* in the vicinities of the apertures or defining the apertures, and annular margins 15*a*, 15*b* and 15*c* protruded to the side of the first grid 10 around the aperture-vicinity flats 14*a*, 14*b* and 14*c*. In addition, the central aperture-vicinity flat 14*b* and the outer aperture-vicinity flats 14*a* and 14*c* are so formed as to be substantially coplanar, while the central annular margin 15*b* is so formed as to be retracted from the plane of the outer annular margins 15*a* and 15*c*. By forming the first grid 10 and the second grid 11 in this manner, the interval lb between the central apertures of both the electrodes 10 and 11 becomes substantially equal to each of the intervals la and lc between the outer apertures thereof.

Figure 1:
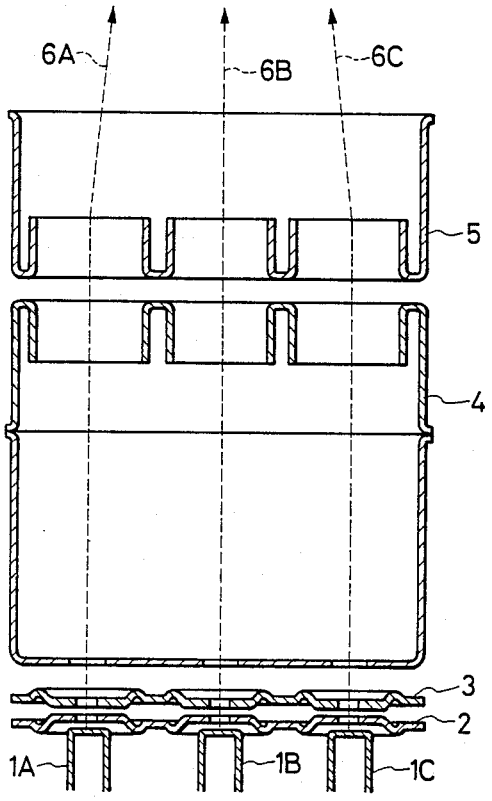
FIG. 1 PRIOR ART
FIG. 1 is a sectional view of essential portions showing the construction of a prior-art example of an electron gun for a color picture tube.
Figure 2:
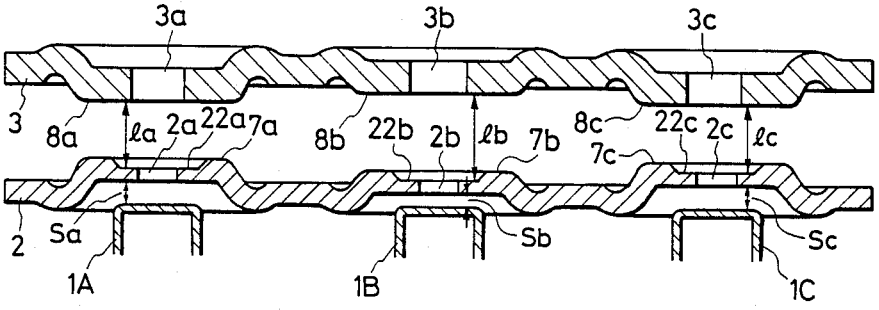
FIG. 2 PRIOR ART
FIG. 2 is an enlarged sectional view of a triode portion in FIG. 1.
Figure 3:
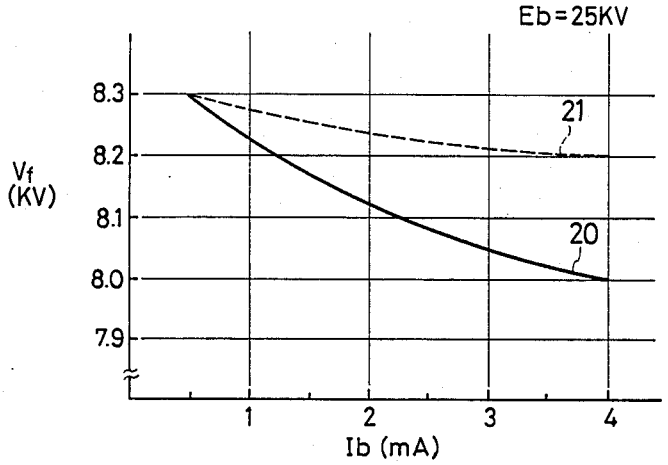
FIG. 3 is a characteristic diagram showing the relationships between the beam current and the optimum focusing voltage of an electron gun for a color picture tube.
Figure 5:
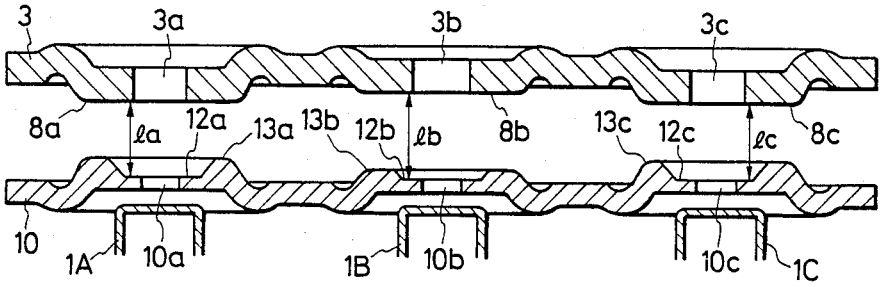
FIG. 5 is a sectional view showing the construction of another embodiment of the present invention.

FIG. 5 shows another embodiment of the present invention. The first grid 10 has the same configuration as in FIG. 4, while the second grid 3 has the same configuration as that of the second grid of the prior art in FIG. 2. Further, annular margins formed around aperture-vicinity flats 8*a*, 8*b*, 8*c* and an identical plane containing them.

In case of the present embodiment, the interval lb between the central apertures of both the electrodes 10 and 3 and each of the intervals la and lc between the outer apertures thereof are not equal, but they have their difference made smaller than in the prior art and can be substantially equalized.

Figure 6:
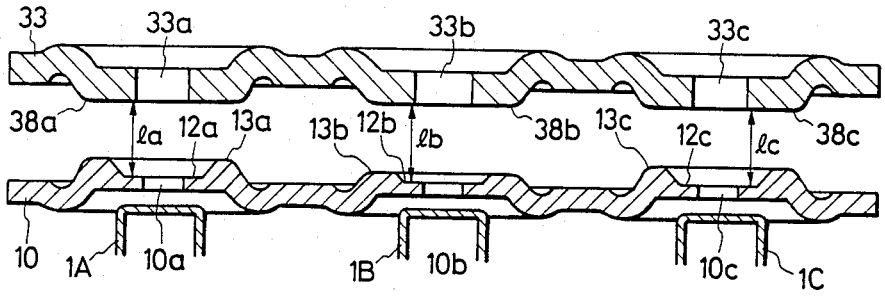
FIG. 6 is a view showing the construction of still another embodiment of the present invention.

FIG. 6 shows another embodiment of the present invention. The first grid 10 is the same as shown in FIG. 4, while the second grid 33 is such that flats 38*a*–38*c* in the vicinities of a central aperture 33*b* and outer apertures 33*a*, 33*c* opposing to the first grid 10 are formed on an identical plane. Thus, the interval between the central apertures of both the grids can be equalized to each of the intervals between the outer apertures thereof. On this occasion, in a case where an error has developed between the flatness of the central aperture-vicinity flat 38*b* of the second grid 33 and that of the outer aperture-vicinity flat 38*a* or 38*c* thereof, the stabilities of spacers might become somewhat unsatisfactory. Since, however, the second grid has a higher voltage applied as compared with the first grid, the structural mechanical accuracy of the second grid is usually less influential on the behaviors of electron beams than that of the first grid. Accordingly, the required mechanical accuracy of the second grid is not so severe as that of the first grid, and the embodiment in FIG. 6 can be put into practical use.

The difference between the intervals lb and la (or lc) has heretofore been 20–50 μm. In contrast, it becomes 10 μm or less with the embodiment shown in FIG. 4 or FIG. 6, and it becomes 10–25 μm with the embodiment shown in FIG. 5. Thus, any of the embodiments has the effect that the difference of the intervals can be reduced to a half or less with respect to the prior art.

Moreover, the embodiment is so constructed that, when the spacers for setting the mutual interval between the first grid 10 and the second grid 11 or are interposed between these grids 10 and 11 or 3, the outer beam aperture portions of at least the first grid 10 come into contact with the spacers. Therefore, the stabilities of the grids are good, and the orthogonalities of and the mutual parallelism between the first grid 10 and the second grid 11 or 3 are held favorable.

In this way, the interval lb between the central apertures of the first grid 10 and the second grid 11 or 3 can be equalized or substantially equalized to each of the intervals la and lc between the outer apertures thereof, and also the spacing Sb between the cathode 1B and the aperture 10*b* of the first grid 10 can be substantially equalized to each of the spacings Sa, Sc between the cathodes 1A, 1C and the outer apertures 10*a*, 10*c* of the first grid 10. Therefore, the electron optical characteristics of the central electron beam and the outer electron beams in the triode portion can be equalized, and the variations of the optimum focusing voltages to arise when the beam currents of the electron beams can be brought into agreement for both the sorts of electron beams.

Figure 7:
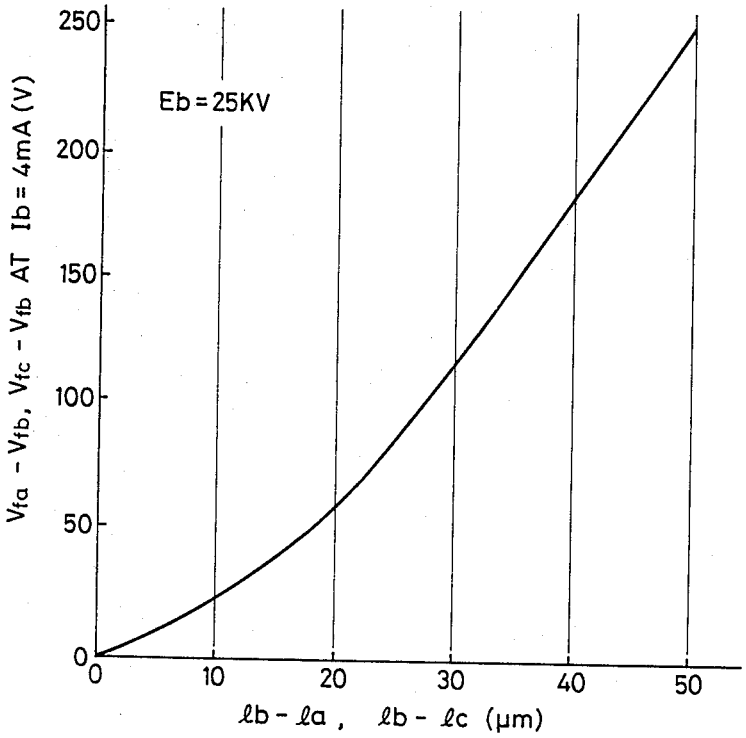
FIG. 7 is a characteristic curve diagram for explaining the operation of the present invention.

FIG. 7 shows the experimental result of the relationship between the difference of the interval lb of the central apertures and the interval la or lc of the outer apertures of the first and second grids, and the difference of the optimum focusing voltage $V_{fb}$ of the central electron beam and the optimum focusing voltage $V_{fa}$ or $V_{fc}$ of the outer electron beam at beam currents $I_b=4$ mA.

Experimental results indicate that the differences $V_{fa}-V_{fb}$ and $V_{fc}-V_{fb}$ should desirably be within 100 V for the purpose of attaining a good picture quality. It is accordingly understood from FIG. 7 that the differences lb−la and lb−lc need to be held at, at most, 25 μm. The embodiments of the constructions in FIGS. 4, 5 and 6 satisfy this requirement.

As apparent from the above description, according to the present invention, the mutual parallelism between a first grid and a second grid can be maintained, and besides, the electron optical characteristics of a triode portion for a central electron beam and outer electron beams can be brought into substantial agreement. Therefore, the beam current—versus— optimum focusing voltage characteristics of the central electron beam and the outer electron beams can be brought into substantial agreement, and excellent picture qualities are attained over all beam currents.

Although, in the above, only the case of plate-like electrodes has been described, it is needless to say that a similar effect is produced by the use of cup-like electrodes.

Incidentally, the annular margins stated before are not necessarily formed into margins in the shape of continuous lines. Insofar as the intended purpose can be met in case of inserting the spacers and assembling the electrodes as already explained, the margin for each of the apertures of the grids may well be formed of dot parts or the likes.

What is claimed is:

1. In an electron gun for a color picture tube having three cathodes which are arrayed orthogonally to an axial direction of the tube and at equal intervals on a straight line, and a first grid and a second grid which are successively arrayed and each of which has apertures aligned with electron beam paths corresponding to the three cathodes; said electron gun for a color picture tube characterized in that a surface of said first grid opposing to said second grid comprises aperture-vicinity flats corresponding to the respective apertures aligned with the electron beam paths, and annular margins protruded to a side of said second grid around said aperture-vicinity flats, and that said annular margin corresponding to said aperture aligned with the central electron beam path is retracted from a plane which contains the two annular margins corresponding to said apertures aligned with the outer electron beam paths, while said aperture-vicinity flats for said apertures of said first grid aligned with the three electron beam paths are all formed on an identical plane.

2. An electron gun for a color picture tube as defined in claim 1, characterized in that a surface of said second grid opposing to said first grid comprises aperture-vicinity flats corresponding to the respective apertures aligned with the electron beam paths, and annular margins protruded to a side of said first grid around said aperture-vicinity flats, and that said annular margin corresponding to said aperture aligned with the central electron beam path is retracted from a plane which contains the two annular margins corresponding to said apertures aligned with the outer electron beam paths, while said aperture-vicinity flats for said apertures of said second grid aligned with the three electron beam paths are all formed on an identical plane.

3. An electron gun for a color picture tube as defined in claim 1, characterized in that a surface of said second grid opposing to said first grid comprises aperture-vicinity flats corresponding to the respective apertures aligned with the electron beam paths, and annular margins formed around said aperture-vicinity flats and on an identical plane containing them, and that said aperture-vicinity flats for said apertures of said second grid aligned with the three electron beam paths are all formed on an identical plane.

4. An electron gun for a color picture tube as defined in claim 1, characterized in that a surface of said second grid opposing to said first grid comprises aperture-vicinity flats corresponding to the respective apertures aligned with the electron beam paths, and annular margins formed around said aperture-vicinity flats and on an identical plane containing them, and that said annular margin corresponding to said aperture aligned with the central electron beam path is retracted from a plane which contains the two annular margins corresponding to said apertures aligned with the outer electron beam paths.

* * * * *